US008231187B2

(12) United States Patent
Hoffman

(10) Patent No.: US 8,231,187 B2
(45) Date of Patent: Jul. 31, 2012

(54) HINGE BRACKET FOR A POCKET DOOR

(75) Inventor: Keith A. Hoffman, Hudsonville, MI (US)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 107 days.

(21) Appl. No.: 12/789,737

(22) Filed: May 28, 2010

(65) Prior Publication Data

US 2010/0314980 A1 Dec. 16, 2010

Related U.S. Application Data

(62) Division of application No. 11/328,554, filed on Jan. 10, 2006, now abandoned.

(51) Int. Cl.
*A47B 96/06* (2006.01)

(52) U.S. Cl. ..... 312/322; 16/382; 16/96 D

(58) Field of Classification Search ..... 312/322, 312/323, 326, 327, 329, 332, 334.5, 311, 312/110, 139.1; 248/200, 300; 16/382, 236, 16/237, 239, 241, 96 D; 49/208, 254, 257, 49/260

See application file for complete search history.

(56) References Cited

U.S. PATENT DOCUMENTS

| | | | | | |
|---|---|---|---|---|---|
| 962,228 | A * | 6/1910 | Kuersten | 312/139.1 |
| 1,209,560 | A * | 12/1916 | Cosner | 248/488 |
| 1,778,943 | A * | 10/1930 | Hoffmann | 126/37 R |
| 1,873,247 | A * | 8/1932 | Abbott et al. | 109/70 |
| 2,936,206 | A * | 5/1960 | Wilmer et al. | 312/322 |
| 4,547,930 | A * | 10/1985 | King et al. | 16/382 |
| 4,729,612 | A * | 3/1988 | Stone | 312/109 |
| 4,910,916 | A * | 3/1990 | Dubach et al. | 49/257 |
| 4,974,912 | A | 12/1990 | Rask et al. | |
| 5,108,165 | A | 4/1992 | Rorke et al. | |
| 5,149,180 | A * | 9/1992 | Haab et al. | 312/322 |
| 5,624,170 | A * | 4/1997 | Hasty | 312/329 |
| 6,282,770 | B1 | 9/2001 | Lyon | |
| 6,286,917 | B1 | 9/2001 | Strong | |
| 6,435,635 | B1 | 8/2002 | Lyon | |
| 7,127,775 | B2 * | 10/2006 | Ferre et al. | 16/223 |
| 2004/0046488 | A1 * | 3/2004 | Hogan | 312/322 |
| 2004/0239216 | A1 | 12/2004 | Castillo | |

OTHER PUBLICATIONS

Model 123 European Hinge, Model 1234 without Hinge, Installation Instructions issued by ACCURIDE International Inc (4 Sheets) (bears copyright date of 2002; date otherwise unknown).

Model 1321 European Hinge, Pro Pocket Flipper Door Slide Installation Instructions issued by ACCURIDE International Inc (4 Sheets) (bears copyright date of 2003; date otherwise unknown).

Model 1332, Model 1432 Installation Instructions issued by ACCURIDE International Inc (8 Sheets) (bears copyright date of 2002; date otherwise unknown).

Pocket Door Hardware System Selection/Specification Manual issued by Blum, Inc. (6 Sheets) (bears copyright date of 2004; date otherwise unknown).

* cited by examiner

*Primary Examiner* — James O Hansen
*Assistant Examiner* — Matthew Ing
(74) *Attorney, Agent, or Firm* — Cook Alex Ltd.

(57) ABSTRACT

A hinge bracket attachable to a pocket door slide system wherein the pocket door slide system comprises components capable of achieving a full inset or partial overlay pocket door position without the hinge bracket, and wherein use of the hinge bracket enables the pocket door slide system to achieve a substantially full overlay pocket door position.

14 Claims, 8 Drawing Sheets

HINGE BRACKET FOR A POCKET DOOR

CROSS-REFERENCE TO RELATED APPLICATION

This application is a divisional of abandoned U.S. patent application Ser. No. 11/328,554, filed Jan. 10, 2006, the disclosure of which is hereby incorporated by reference in its entirety.

BACKGROUND OF THE INVENTION

1. Field of the Invention

The present invention relates to slide and hinge suspension systems for supporting cabinet doors. More particularly, the present invention relates to a hinge bracket for use in converting common pocket door slide systems from achieving an inset or a partial overlay configuration when the door is in a closed position to achieving a full overlay configuration when the door is in a closed position.

2. Description of the Related Art

It has become more common for cabinets to be used as entertainment centers to house televisions or other audio and/or visual equipment. The design of such cabinets has evolved into a fairly common style of product. Entertainment centers often comprise an upright cabinet that may be camouflaged by style and finish to appear as though it were one of the existing pieces of furniture in a room.

This type of cabinet typically has a pair of large doors that enclose a front opening in an upper portion of the cabinet. These doors may be opened to reveal a television set, stereo or other entertainment system that has been conveniently hidden from view until it is desired to be used. Many times, these cabinets are found in hotel rooms where they combine a series of drawers within a lower portion of the same cabinet, providing storage as well as the provisions for the entertainment center.

Because it has been found to be desirable to keep the components of the entertainment center out of sight when not in use, the doors that are found on such cabinets provide an important function of concealment. As the design of this type of cabinetry evolved, it was not satisfactory to have the doors merely hinged onto the sides of the cabinet walls because they could rotate back into a semi-closed or fully closed position but would potentially obscure the entertainment center or present an obstacle in proximity of the cabinet.

As a result, suspension systems for hanging the doors on such cabinets were developed to allow the doors to be hinged to an open position, and thereafter, to traverse rearward into the interior of the cabinet, into a so-called "pocket" space in parallel alignment with the cabinet side walls. The door suspension systems have typically been based upon the usage of drawer slide technology, notably precision drawer slide technology using telescoping slide members and ball or roller bearings, such as is found in office furniture applications and the like, although other more simplistic drawer slides may be used. In the case of such door applications, however, it is necessary to use a specialized slide adapted in a way that allows the door to be mounted to a portion of a sliding element, while at the same time allowing it to hinge when it reaches the fully opened position. In this manner, the functionality of the suspension system provides both a hinged opening and closing relationship relative to the door and the hinge, as well as a translational action between a forward position at a ninety degree angle to the front of the cabinet, and a rearward position within the cabinet body.

Given their movement and storage position within the cabinet, doors of this type have become known as "pocket doors". In turn, the slide suspension systems that support each pocket door in these applications have become known as "pocket door slides".

A number of pocket door slide systems have been developed in the prior art, with particular structures designed to keep the doors from sagging, racking or otherwise becoming misaligned when in position to be moved rearward into the cabinet or forward out from the cabinet. For instance, there are systems that use a rigid follower strip, anti-racking plate or bar, made for instance of wood, metal or other suitable materials or combinations thereof, and connected to the upper and lower pocket door slides and their hinge mounting assemblies, such as are shown in U.S. Pat. No. 5,108,165, to positively maintain the alignment of such components. Alternatively, there are pocket door slide systems that use a cable system to keep the door aligned by connecting the slide assemblies and their hinges, such as disclosed in U.S. Pat. Nos. 4,974,912 and 5,395,165. Further alternative alignment components for pocket door slide systems are disclosed in U.S. Patent Application Publication US 2004/0046488. These systems utilize rack and pinion components that offer a pair of racks and pinion gears for each slide, which are connected via an axle. While such systems may be constructed in many forms and may be used with a pair of hinges on a standard door, such rack and pinion systems may be constructed to be particularly well suited for maintaining alignment of very large pocket doors that require more than two hinges.

In all of these or other prior art pocket door slide systems, the slides are typically mounted to the inner surface of the outer side walls of the cabinet. In turn, hinges commonly known as a "Euro-hinge", manufactured for instance by Arutro Salice S.p.A., typically have either a 35 mm or 40 mm hinge mounting cup, and are mounted to the slides to achieve full inset doors, i.e., doors that when hinged to the closed position are recessed so as to have their front surface be substantially flush with, or in the same plane as, the front edges of the cabinet side walls. These hinges have numerous advantages, including their three-way adjustability and the ability to remove the hinged door easily from the cabinet.

With full inset doors, a gap exists between the outer edge of each door and the respective adjacent cabinet side wall when the door is in the closed position. In applications where the piece of furniture has a cabinet above drawers and the drawers also are of the inset style, this is acceptable. However, a popular style is full overlay, where the doors and drawers fully overlay the cabinet sides which are typically ¾" thick. It is desirable to match the pocket doors to the full overlay drawers, but to date, the systems capable of achieving a full overlay for pocket doors when in a closed door position require specialized slide components, or specific components necessary to modify the cabinet, which are unique to a full overlay application, as opposed to using commonly stocked components and cabinet structures from an inset system.

An example of a system having specialized slide components is disclosed in U.S. Patent Application Publication US 2004/0239216. However, such systems are more complicated and expensive. The need to stock specialized slides, which are a fairly costly part of a pocket door slide system, just for use in full overlay pocket door applications, is not desirable.

Similarly, an example of a cabinet requiring specialized components to modify the cabinet to achieve a full overlay system is disclosed in U.S. Pat. No. 5,108,165. This cabinet system requires specialized columnar frame members to be mounted to an inner cabinet wall to space the entire slide and hinge system from the inner wall, as well as a specific anti-rack plate to achieve the full overlay result. Once again, the specialized nature of the components and mounting is not desirable.

Alternatively, some systems have attempted to use hinges mounted on a thinly milled wood follower strip to achieve partial pocket door overlay. However, due to the limitations of the wood strength and the need to fasten the hinge bases to the follower strips at the thinned sections, only modest improvement in door overlay has been achieved using these designs. As a result, these modified systems are not capable of achieving a full overlay position, and thus do not cover the entire front edge of the adjacent side wall.

Therefore, it would be advantageous to be able to convert conventional pocket door slide system hardware, that utilizes relatively standard drawer slides and common Euro-hinge style components regularly stocked by cabinet manufacturers and designed to achieve an inset or partial overlay position, to a system that can alternatively achieve a full overlay position for pocket doors when in the closed position. It also would be advantageous to be able to achieve the full overlay position regardless of which pocket door slide system is used to maintain the door alignment, whether it be of the type which uses an anti-racking bar, cable system, rack and pinion, or other approach to coordinating the movement of the drawer slides.

It further would be advantageous to be able to utilize a single bracket for all hinge mounting positions, whether on the left or right side of the cabinet and whether it be for use with an upper or lower slide.

It also would be advantageous to be able to achieve such conversion of hardware, whether the particular application has one or two hinges associated with each slide unit.

In the full overlay position, each door is positioned to fully cover the front edge of the respective adjacent cabinet side wall. To the knowledge of the inventors, prior to the development of the present invention, the common slides and Euro-hinge style hinges used for inset or partial overlay pocket doors were not able to be conveniently adapted to achieve a full overlay position for pocket doors when hinged to the closed position.

SUMMARY OF THE INVENTION

The purpose and advantages of the invention will be set forth in or otherwise apparent from the description and drawings that follow, as well as will be learned by practice of the invention.

The present invention is generally embodied in a hinge bracket attachable to a pocket door slide system wherein the pocket door slide system comprises components capable of achieving a full inset or partial overlay pocket door position without the hinge bracket, and wherein use of the hinge bracket enables the pocket door slide system to achieve a substantially full overlay pocket door position.

In another aspect of the invention, the hinge bracket has a first planar portion and at least one second planar portion with the first and second planar portions positioned in two spaced apart and substantially parallel planes.

In a related further aspect of the invention, the hinge bracket has at least one offset portion connecting the first planar portion to a second planar portion.

In another aspect of the invention, the hinge bracket has a first planar portion located in a first plane and a pair of second planar portions located in a second plane spaced apart from and substantially parallel to the first plane.

In a related further aspect of the invention, the hinge bracket has a pair of offset portions, wherein each offset portion connects the first planar portion to a second planar portion.

In yet another aspect of the invention, a pocket door slide system is adapted to mount a door to a cabinet having a side wall wherein when the door is in a closed position an outer edge of the door is substantially in the same plane as an outer surface of the side wall, the pocket door slide system having at least two pocket door slides, each pocket door slide having a slidable member, and a hinge bracket being connectable to the slidable member by at least one fastener at a first location on the hinge bracket and having at least one pair of holes spaced 32 mm apart and being connectable to a respective at least one hinge at a second location on the hinge bracket, wherein the hinge is further adapted to be connected to a door.

In a related further aspect of the invention, the first location is located on a first planar portion of the hinge bracket and the respective second location is located on a respective second planar portion of the hinge bracket, wherein the first planar portion is in a first plane and the respective second planar portion is in a second plane spaced from and substantially parallel to the first plane.

In a further related aspect of the invention, the hinge bracket comprises at least two second locations, with each second location being located on a respective second planar portion.

Thus, the present invention presents an alternative to prior art specialized drawer slide and cabinet components needed to achieve a full overlay position for pocket doors. The present invention also simplifies the structure needed to achieve full overlay pocket doors by using simple hinge brackets to convert conventional pocket door slide system components that were designed for inset or partial overlay doors. With present known Euro-hinge geometry, substantially full overlay may be achieved on cabinets having a side wall thickness of up to approximately ¾". It will be appreciated that changes in hinge geometry may yield increased or decreased side wall overlay capabilities.

It is to be understood that both the foregoing general description and the following detailed description are exemplary and provided for purposes of explanation only, and are not restrictive of the invention, as claimed. Further features and objects of the present invention will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

It should be understood that the drawings are not necessarily to scale and provide various views of assemblies that are within the spirit and scope of the invention which may be used in various configurations of pocket door slide systems. While some mechanical details of such systems, including other plan and section views of the particular components, have been omitted, such details are considered well within the comprehension of those skilled in the art in light of the present disclosure. It also should be understood that the present invention is not limited to the preferred embodiments illustrated.

DESCRIPTION OF THE PREFERRED EMBODIMENT

Referring generally to FIG. 2-8D, it will be appreciated that the present invention generally may be embodied within numerous configurations within pocket door slide systems for pocket doors.

Figure 1:
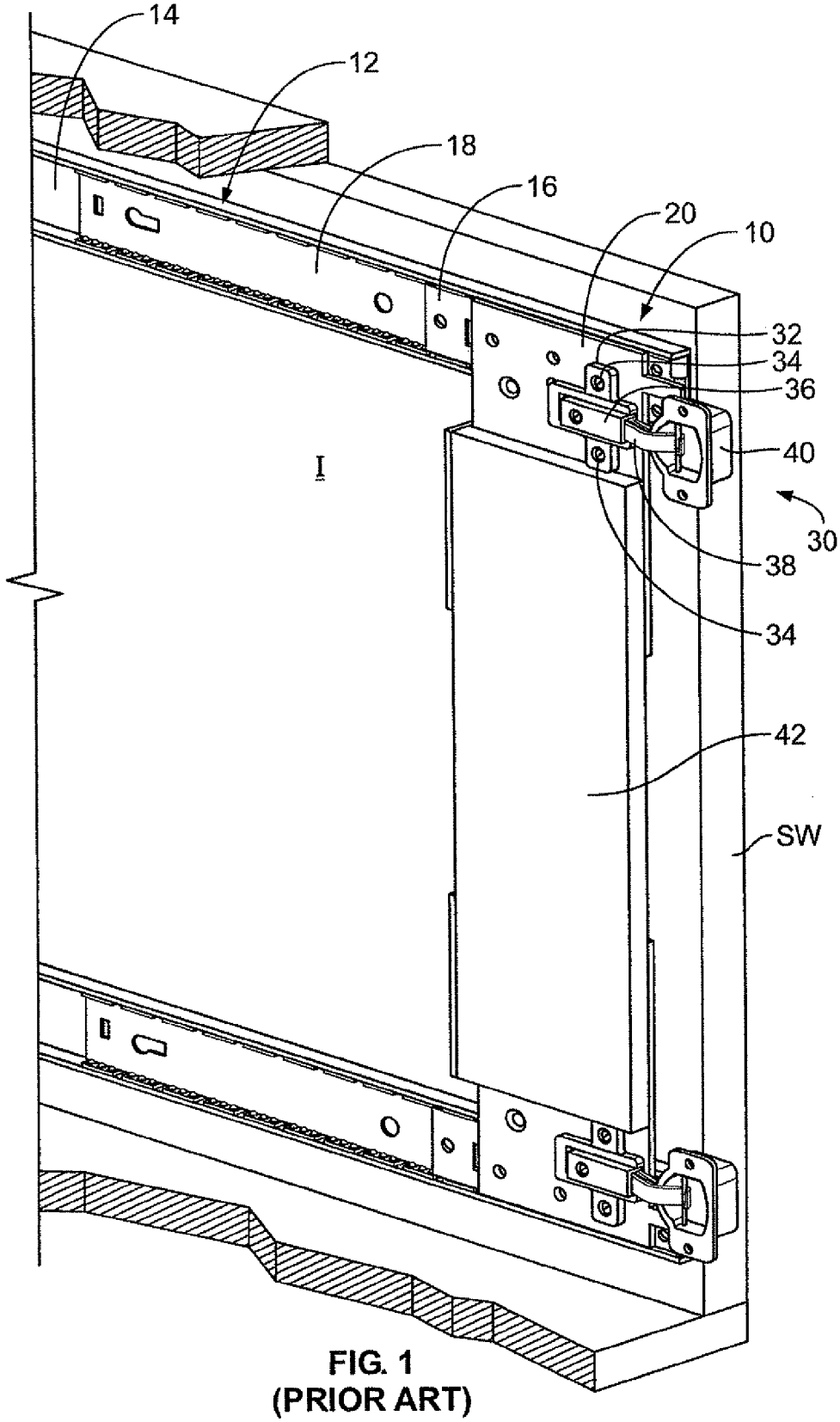
FIG. 1 (PRIOR ART)
FIG. 1 is a front perspective view of a prior art, conventional pocket door slide system for an inset door configuration, as it would be configured with a follower strip alignment system and with the slide mounted to the inner surface of an outer wall of a cabinet.

In accordance with FIG. 1, a prior art conventional pocket door slide system 10 for an inset door configuration is shown. Pocket door slide system 10 includes a pair of complimentary upper and lower slide and hinge systems, one of which will be described in detail for clarity and ease of viewing. However, it will be appreciated by one of skill in the art that the two are complimentary and are essentially configured as a mirror image of each other.

Thus, pocket door slide system 10 includes slides 12 mounted, such as by conventional screw type fasteners (not shown) to the inner surface I of a right hand outer side wall SW of a cabinet. Slides 12 are shown as having an outer track 14 and an inner slide member 16 which may include, for instance, ball bearing retainers 18 that permit inner slide member 16 to translate forward and rearward with respect to outer track 14. Pocket door slide system 10 further includes a backing plate 20 mounted to inner slide member 16, such as by welding at two or more spot welds, or by other suitable fastening means for connection or manufacture of an integral piece.

To provide the hinge motion necessary to move a door from an open position, parallel to side wall SW, to a closed position, inset and perpendicular to SW, hinges 30 are provided. In this prior art embodiment, system 10 is equipped with Euro-hinge style hinges 30 which are well known in the art. Hinges 30 include a base 32 mounted to backing plate 20, such as by conventional screw type fasteners 34, a body 36 connected to base 32, hinge arms 38 extending from body 36 and connected to a door mounting cup 40. Door mounting cup 40 is configured to be mounted by conventional means to a recess in a door (not shown) which is conventional in the art. Also of note, the holes through hinge base 32 for mounting to a backing plate typically have a standard spacing of 32 mm apart.

In order to maintain proper door alignment, system 10 also includes a follower strip 42 or anti-racking plate mounted to backing plates 20 of the upper and lower slide and hinge systems. Follower strip 42 is shown as being made of a solid material, such as wood, for ease of mounting to backing plate 20 with conventional fasteners, such as screws or the like (not shown). Follower strip 42, which it will be appreciated may be in many different forms, serves to keep inner slide members 16 moving in unison so as to prevent racking of the pocket door.

This prior art, conventional pocket door slide system 10, as described, uses conventional slide and hinge components designed to achieve an inset door position when the pocket door is in a fully closed position. As such, when in the closed position, the outer or front surface of the pocket door will be relatively flush with or in the same plane as the front edge of side wall SW. However, as previously mentioned, the door will not match the styling of the full overlay drawers.

Figure 2:
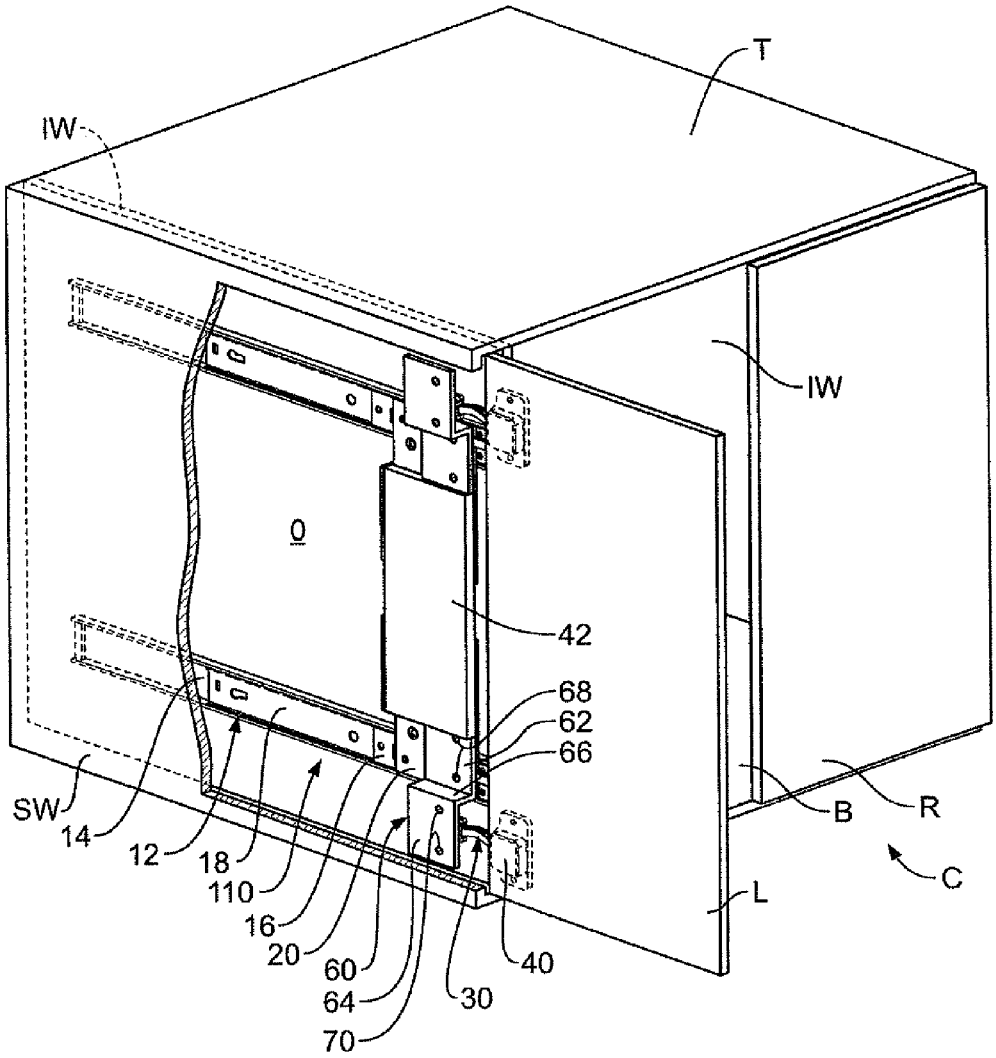
FIG. 2 is a front perspective view of a first embodiment in accordance with the invention where a hinge bracket is used with the hardware of each conventional pocket door slide system of FIG. 1 to convert to a full overlay system, wherein the system is shown in relation to a cabinet and the slide is mounted to the outer surface of an inner cabinet wall.
Figure 3:
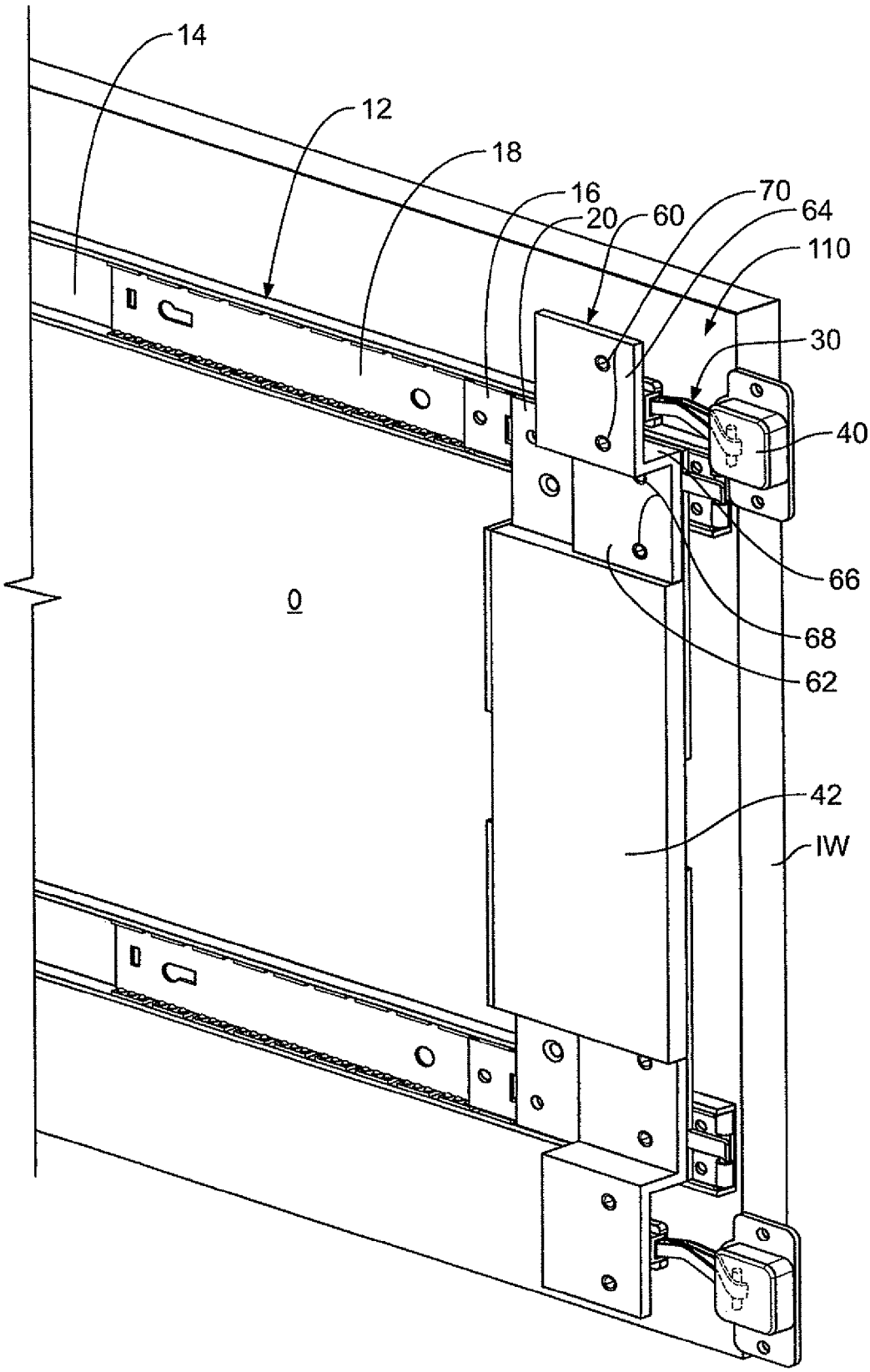
FIG. 3 is a more isolated front perspective view of the converted pocket door slide system of FIG. 2 with the slide mounted to the outer surface of an inner cabinet wall.

Now turning to FIGS. 2 and 3, a cabinet C is shown in FIG. 2 having a full overlay pocket door slide system 110 consistent with the present invention. Cabinet C comprises at least a top panel T, a bottom panel B, left and right outer side walls SW, left and right inner walls IW, and left and right pocket doors L and R, respectively. Left and right inner walls IW may be fastened in place within cabinet C in a conventional manner, such as by using L-shaped brackets and conventional screw type fasteners, or by other suitable means. It will be appreciated that each door has a respective system 110, although the right inner wall effectively hides the right hand system from view. Cabinet C may take many forms, need not be part of an entertainment center, and it will be understood that it generally is representative of the upper portion of an entertainment center having pocket doors.

As seen in FIGS. 2 and 3, pocket door slide system 110 also is constructed with upper and lower slides with hinges, one of which will be described in detail for clarity and ease of viewing. Again however, it will be appreciated by one of skill in the art that the two are complimentary and are essentially configured as a mirror image of each other to achieve a pocket door slide system 110.

With respect to left door L, system 110 is mounted to the outer surface 0 of left inner wall IW of cabinet C. More particularly, each of the slides 12 of suspension system 110 is mounted, such as by conventional screw type fasteners (not shown) to the outer surface 0 of left hand inner wall IW of cabinet C. Slides 12 may be constructed as described in relation to the prior art conventional slides in FIG. 1, having an outer track 14, an inner slide member 16, and ball bearing retainers 18. Similarly, suspension system 110 further includes a backing plate 20 mounted to inner slide member 16, as described in relation to FIG. 1.

Each of the slide and hinge systems of pocket door slide system 110 also includes a hinge bracket 60 mounted to backing plate 20 by conventional fasteners. Hinge bracket 60 has first and second planar portions 62 and 64, and an offset portion 66 connected to and between planar portions 62 and 64 so as to locate planar portions 62 and 64 in spaced apart substantially parallel respective planes. The offset preferably being in the range of 0.59 to 1.13 inches to accommodate common component thicknesses and hinge heights. First planar portion 62 preferably has a pair of mounting holes 68 by which hinge bracket 60 may be mounted to backing plate 20 by conventional fasteners. Mounting holes 68 are preferably in the same configuration as would be the mounting holes of a conventional hinge base 32, such as with a 32 mm spacing, so that new fastening holes need not be made in backing plate 20 to accommodate the mounting of hinge bracket 60.

Pocket door slide system 110 uses the same conventional Euro-hinge style hinges 30 as used in prior art system 10. However, hinge 30 is mounted to the inner surface of second planar portion 64, which preferably has a pair of mounting holes 70 to mount hinge 30 by conventional fasteners. To readily accept mounting of hinge base 32, holes 70 are preferably of the same configuration as the original mounting holes in backing plate 20, such as 32 mm apart. In addition, respective mounting holes 68 and 70 are preferably aligned, so as to maintain the same fore and aft location of left door L with respect to the slide member, as best seen with respect to backing plate 20. If respective mounting holes 68 and 70 are aligned and centered with respect to bracket 60, then bracket 60 will be universally adapted for left and right doors and for both top and bottom slide assemblies. It will be appreciated that if the respective mounting holes 68 and 70 are aligned but not centered with respect to bracket 60, each upper and lower bracket 60 would be a mirror image of one another, and therefore, it may be preferable to have a tab or other locating feature to assure proper orientation of bracket 60 to prevent improper assembly.

In this configuration, left door L is then mounted to door mounting cup 40 of hinge 30 in a conventional manner. Pocket door slide system 110 also is able to use the same door alignment hardware as in the prior art system, which includes follower strip 42 mounted to backing plates 20 of the upper and lower slide and hinge systems.

Thus, it will be appreciated that by using hinge bracket 60, the mounting of conventional slide and hinge components that are designed for inset pocket door slide systems may be reconfigured to achieve the desired full overlay pocket door slide systems.

Figure 4:
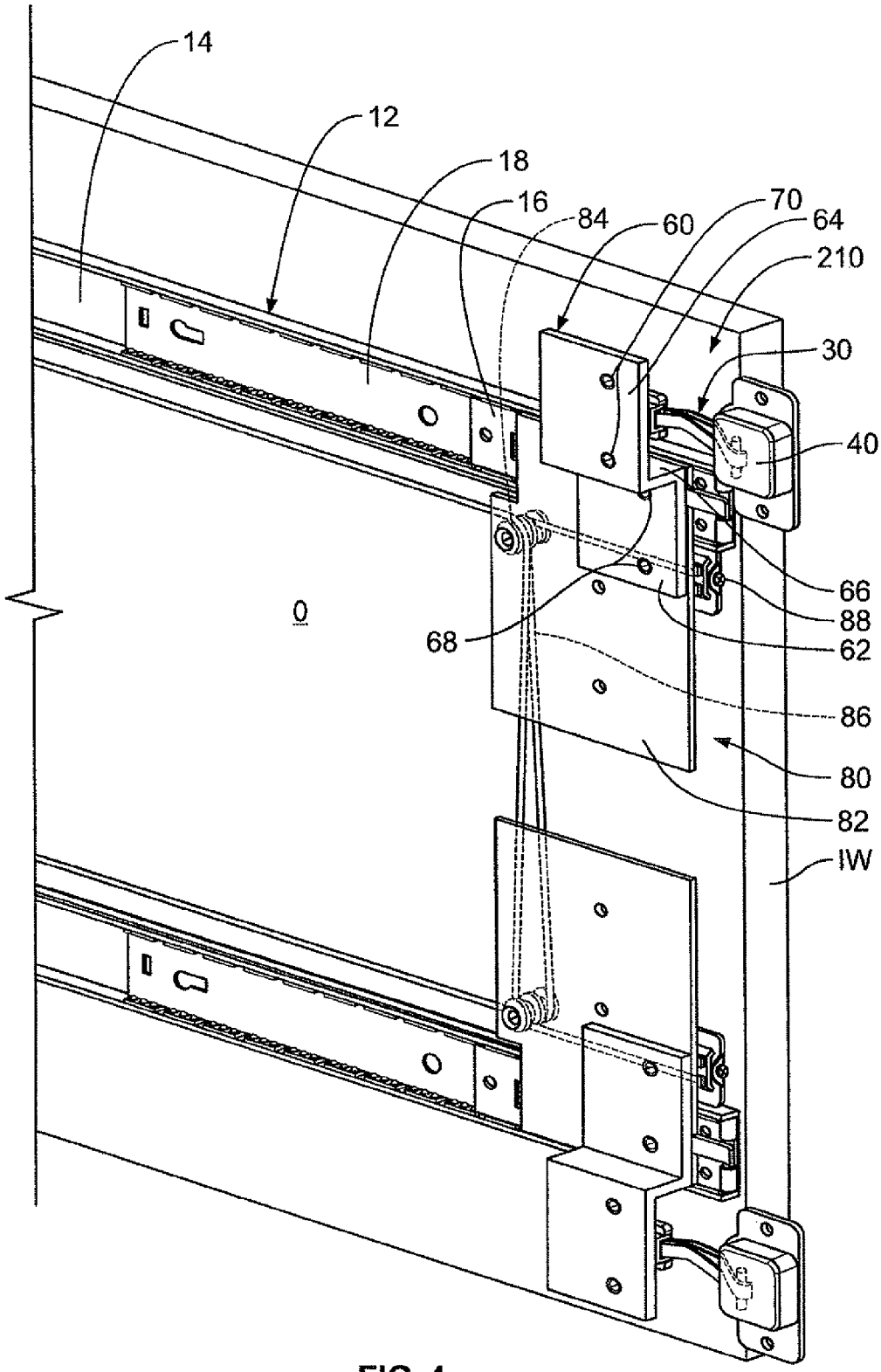
FIG. 4 is a front perspective view of a second embodiment in accordance with the invention where a hinge bracket is used with the hardware of each conventional pocket door slide system that is configured with a cable alignment system to convert to a full overlay system, and wherein the slide is mounted to the outer surface of an inner cabinet wall.

Turning to FIG. 4, a further embodiment in accordance with the invention is shown. FIG. 4 illustrates that hinge brackets 60 may be used with pocket door slide systems that have alternative door alignment means. For instance, the pocket door slide system 210 of FIG. 4 represents a system that uses conventional prior art slide and hinge components of the type having a cable system 80 to synchronize the upper and lower slide and hinge systems to maintain proper door alignment.

Accordingly, pocket door slide system 210 also is constructed with upper and lower slide and hinge systems, similar to those in FIGS. 2 and 3, and would be mounted to outer surface 0 of left inner wall IW of cabinet C. However, pocket door slide system 210 has alternative backing plates 82, pulleys 84, cables 86, forward cable end mountings 88 and rearward cable end mountings (not shown), as substituted for backing plates 20 and follower strip 42. Thus, by using hinge brackets 60, pocket door slide system 210 may be converted from the conventional configuration, in which it would be designed to be mounted to the inner surface of an outer side wall and to achieve an inset or partial overlay pocket door position, to a new configuration in which it is mounted to an outer surface of an inner wall and can achieve a full overlay pocket door slide system.

Figure 5:
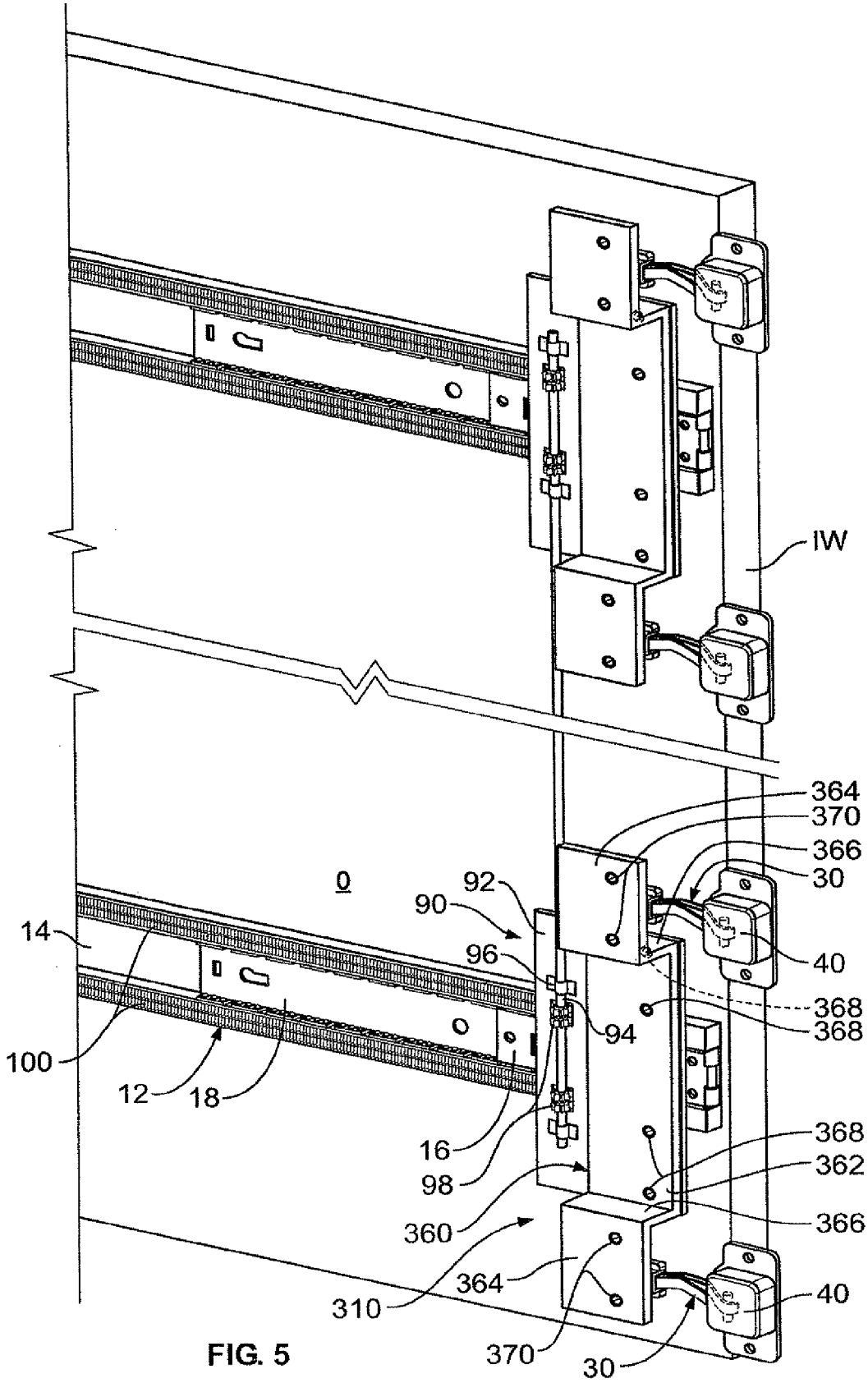
FIG. 5 is a front perspective view of a third embodiment in accordance with the invention where a hinge bracket capable of accepting a plurality of hinges is used with the hardware of each conventional pocket door slide system that is configured with a rack and pinion alignment system to convert to a full overlay system, and wherein the slide is mounted to the outer surface of an inner cabinet wall.

A further alternative embodiment is shown in FIG. 5, for use in slide and hinge suspension systems designed to support very large cabinet doors. In FIG. 5, pocket door slide system 310 is configured to allow a cabinet door to be mounted by four hinges, and incorporates a prior art rack and pinion door alignment system 90, disclosed in U.S. Patent Application Publication US 2004/0046488, to accommodate the increased mass of a larger door, while still using conventional slide and hinge components.

As with the other embodiments, pocket door slide system 310 is constructed with upper and lower slide and hinge systems, one of which will be described in detail for clarity and ease of viewing. Once again, it will be appreciated by one of skill in the art that the two are complimentary and are essentially configured as a mirror image of each other.

Pocket door slide system 310 is shown for use with a left cabinet door. More particularly, each of the slides 12 of system 310 is mounted to the outer surface 0 of a left hand inner wall IW of a cabinet, by similar fastening means to that used with the other embodiments. Slides 12 again may be constructed as described in relation to the prior art conventional slides in FIG. 1, having an outer track 14, an inner slide member 16, and ball bearing retainers 18.

In this embodiment, pocket door slide system 310 further includes alternative backing plate 92 mounted to inner slide member 16, and having an axle or synchronization shaft 94 mounted thereto by means of pillow block type shaft housings 96. Pinion gears 98 are mounted on axle 94 and engage teeth of rack member 100 which is mounted in cooperation with slide 12 to the outer surface 0 of the left hand inner wall IW. This system also uses an alternative hinge bracket 360 in accordance with the invention to accommodate the mounting of two hinges 30 for each respective slide 12.

As shown in FIG. 5, hinge bracket 360 has a first planar portion 362 and a pair of second planar portions 364, with a pair of respective offset portions 366 connecting first planar portion 362 to the respective pair of second planar portions 364, and thereby locating first planar portion 362 and second planar portions 364 in spaced apart substantially parallel respective planes. As in the prior embodiment the offset preferably is in the range of 0.59 to 1.13 inches. First planar portion 362 preferably has two pair of mounting holes 368 by which hinge bracket 360 may be mounted to backing plate 92 by conventional fasteners. Mounting holes 368 are preferably in the same configuration as would be the mounting holes for a pair of conventional hinge bases 32, such as the previously noted 32 mm common spacing, and so that new fastening holes need not be made in backing plate 92 to accommodate the mounting of hinge bracket 360.

Pocket door slide system 310 uses the same conventional Euro-hinge style hinges 30 as in the prior art system 10. However, a hinge 30 is mounted to the inner surface of each of the pair of second planar portions 364, and each preferably has a pair of mounting holes 370 spaced apart in a manner consistent with a hinge base 32 to mount a hinge 30 by conventional fasteners, such as with the previously noted 32 mm common spacing. Similarly to the other embodiments, respective mounting holes 368 and 370 are preferably aligned on bracket 360, so as to maintain the same fore and aft location of left door L with respect to the slide member, as best seen with respect to the front edge of backing plate 92. In this configuration, left door L is then mounted to door mounting cup 40 of each hinge 30 in a conventional manner. Pocket door slide system 310 thus uses alternative hinge brackets 360 to convert hardware designed as an inset pocket door slide system for a large door to a full overlay pocket door slide system.

Figure 6:
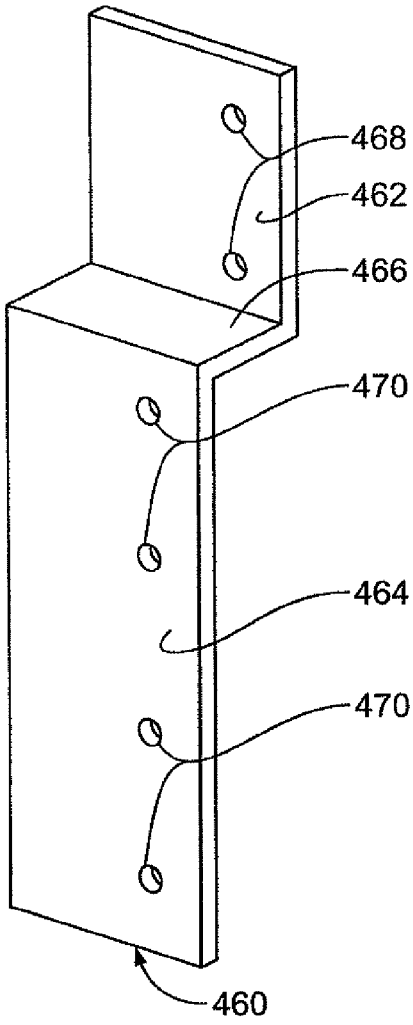
FIG. 6 is a front perspective view of a further embodiment of a hinge bracket in accordance with the invention where the hinge bracket is adapted for use with the hardware of conventional pocket door slide systems and is adapted for mounting a first planar portion to the hinge mounting holes on a slide and a second planar portion is adapted to accept two hinges in a conversion to a full overlay system that uses two hinges per slide.
Figure 7:
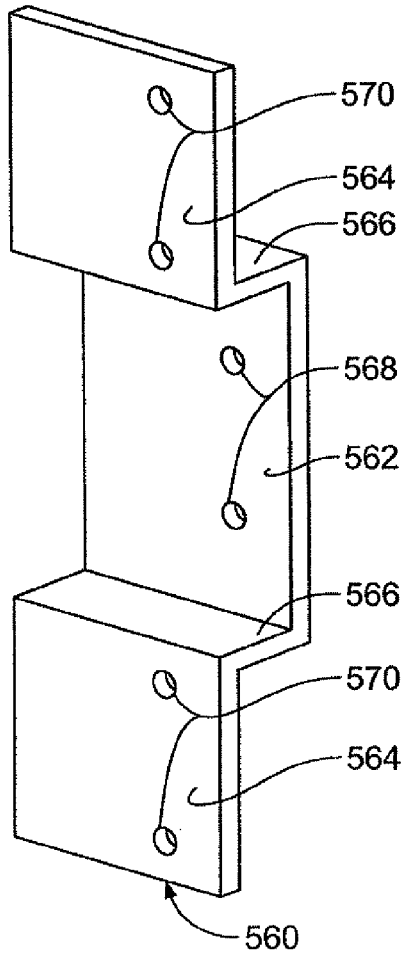
FIG. 7 is a front perspective view of yet another embodiment of a hinge bracket in accordance with the invention where the hinge bracket is adapted for use with the hardware of conventional pocket door slide systems and is adapted for mounting a first planar portion to the hinge mounting holes on a slide and a pair of second planar portions are each adapted to accept a hinge in a conversion to a full overlay system that uses two hinges per slide.

Turning to FIGS. 6 and 7, two examples of further alternative embodiments of hinge brackets in accordance with the invention are shown. These examples represent further hinge brackets of the invention adapted to convert common pocket door slide hardware from a design for use with one hinge per slide and to achieve an inset door to a design for use with two hinges per slide and to achieve a full overlay door. In FIG. 6, a hinge bracket 460 is somewhat like the bracket 60 of FIGS. 2-4, but bracket 460 is adapted to have a first planar portion 462 mounted at a pair of holes 468 to the mounting holes on a slide that would have been used to accommodate a single hinge for an inset door, and has a second planar portion 464 with two pair of hinge mounting holes 470 to accept two hinges of a conventional pocket door slide system. First planar portion 462 and second planar portion 464 are connected by offset portion 466 so as to locate planar portions 462, 464 in spaced apart substantially parallel respective planes.

The embodiment of hinge bracket 560 shown in FIG. 7 is somewhat like the bracket 360 of FIG. 5, but bracket 560 is adapted to have a first planar portion 562 mounted at a pair of holes 568 to the mounting holes on a slide that would have been used to accommodate a single hinge for an inset door, and has a pair of second planar portions 564, each having a pair of hinge mounting holes 570 to collectively accept two hinges of a conventional pocket door slide system. A pair of respective offset portions 566 connect first planar portion 562 to the respective pair of second planar portions 564 in spaced apart substantially parallel respective planes.

The embodiments shown in FIGS. 2-7 demonstrate that the present invention may be used in various configurations to achieve a full overlay closed door position. It will be appreciated that the movement of the door relative to the cabinet will be quite similar in each of these embodiments, and such movement is illustrated generally in FIGS. 8A-8D.

Figure 8A:
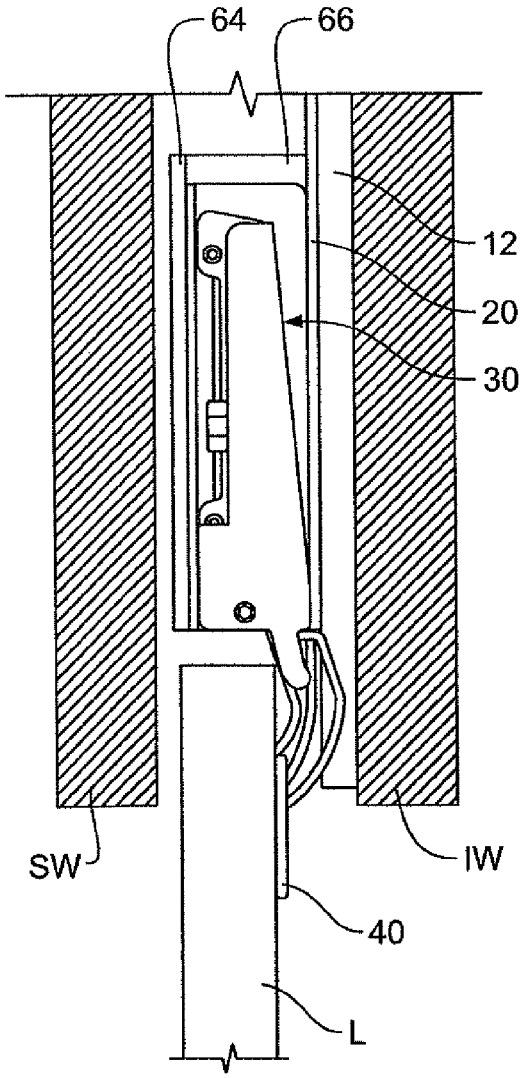
FIGS. 8A-8D are top cross-sectioned views of an embodiment in accordance with the invention showing a pocket door in a series of positions from being moved toward its fully forward position, parallel to the cabinet outer side wall, to hinging to a closed position where it is in a full overlay position relative to the cabinet outer side wall.
Figure 8B:
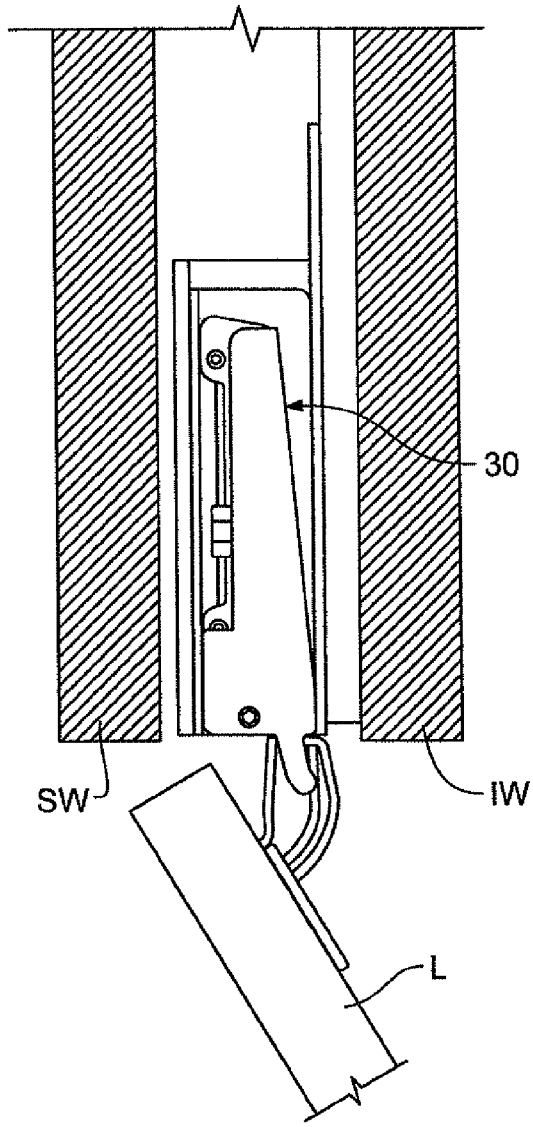
Figure 8C:
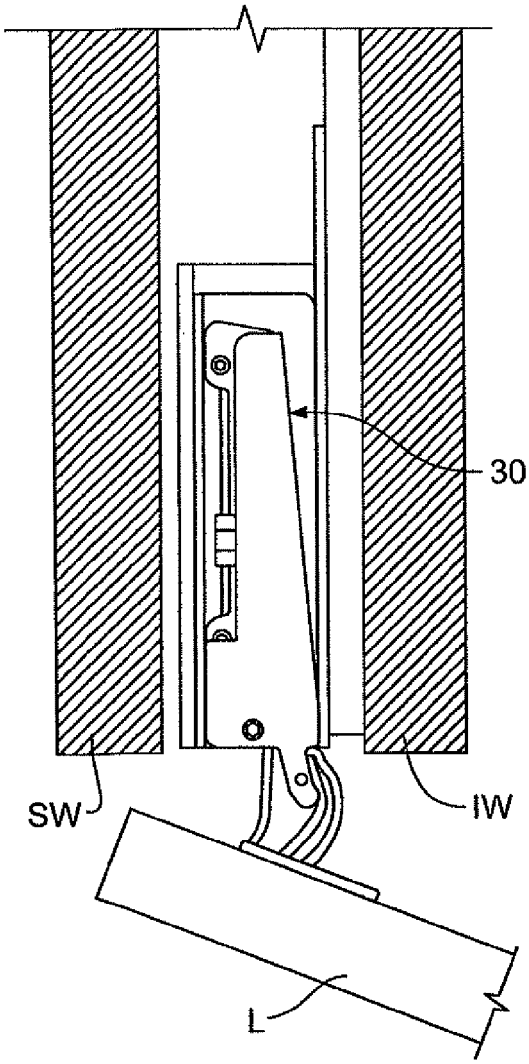
Figure 8D:
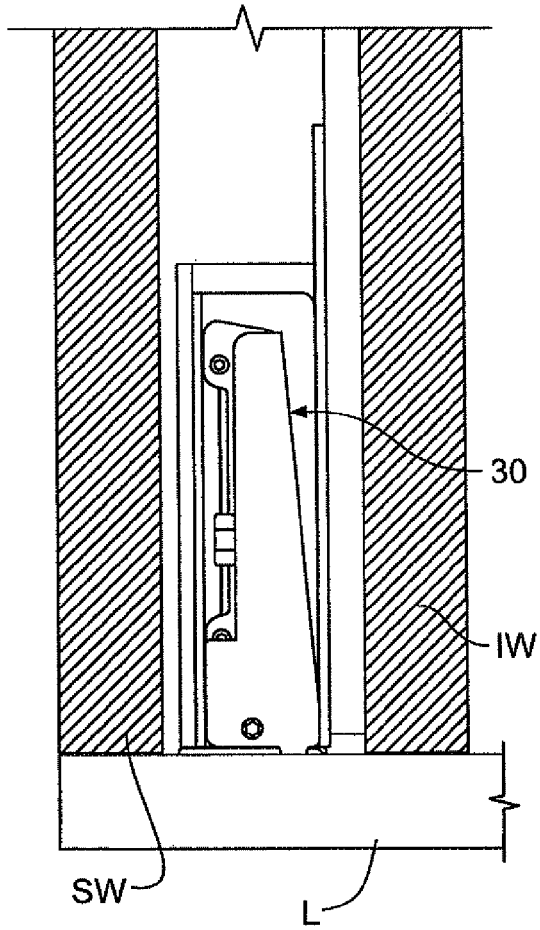

For instance, in FIG. 8A, left door L is shown from a top view with respect to inner wall IW and outer side wall SW. In this view, left door L is in a first position where the door is being moved toward its fully forward position, parallel to the cabinet outer side wall SW. In FIG. 8B, left door L is shown in a second position where the door has been moved to its fully forward position and is being hinged toward a closed position. In FIG. 8C, left door L is shown in a third position where the door is being hinged still closer toward a closed position. In FIG. 8D, left door L is shown in a fourth position where door L has been hinged to a fully closed position, and is located in a full overlay position relative to cabinet outer side wall SW.

It will be appreciated that the pocket door slide systems and hinge brackets disclosed in accordance with the present invention may be provided in various configurations, having any of a number of components used for the slides and to maintain door alignment, and regardless of whether the system has two or more slides and one or more hinges per slide. Also, any variety of suitable materials of construction, configurations, shapes and sizes for the components and methods of connecting the components may be utilized to meet the particular needs and requirements of an end user. It will be apparent to those skilled in the art that various modifications can be made in the design and construction of such components without departing from the scope or spirit of the present invention, and that the claims are not limited to the preferred embodiments illustrated.

What is claimed is:

1. A hinge mounting assembly for use in a cabinet having at least one door and at least two outer side walls and top and bottom panels, the cabinet having at least one pocket door slide system with the pocket door slide system having at least one slide connected to an inner surface of one of the outer side walls and with the hinge mounting assembly including at least a pair of hinges to which at least one door is connectable to be movable from an open position substantially within the cabinet and substantially parallel to the one outer side wall to a closed position having a full inset or partial overlay position relative to the one outer side wall and substantially perpendicular to the one outer side wall, the mounting assembly further comprising a hinge bracket for use in converting the pocket door slide system for use when the cabinet to which the pocket door slide system is to be connected further comprises at least two inner side walls parallel to and spaced inward from the outer side walls, and wherein the at least one door having an outer edge is movable from an open position substantially within the cabinet and with the door substantially parallel to one of the inner side walls to a closed position having a full overlay door position relative to the one outer side wall;

the hinge bracket comprising a first planar portion spaced apart from and within a common plane of a second planar portion, the common plane of the first and second planar portions being spaced apart from and substantially parallel to a third planar portion within a separate plane, the first planar portion being connected to the third planar portion by a first offset portion and the second planar portion being connected to the third planar portion by a second offset portion, wherein the first offset portion is spaced apart from the second offset portion;

wherein the third planar portion of the hinge bracket is adapted to be connected to the at least one slide with the at least one slide being connectable to an outer surface of the inner wall within the cabinet wherein a first hinge of the pair of hinges is connected to the first planar portion, a second hinge of the pair of hinges is connected to the second planar portion, and the first and second hinges are each connectable to the door.

2. A hinge mounting assembly in accordance with claim 1, wherein the first and second offset portions are substantially perpendicular to the first, second and third planar portions.

3. A hinge mounting assembly in accordance with claim 1, wherein the first and second planar portions are spaced apart from the third planar portion in the range of 0.59 to 1.13 inches.

4. A hinge bracket mounting assembly in accordance with claim 1, wherein when the hinge bracket is connected to at least one slide and to at least two hinges for use in a full overlay system within the cabinet having inner side walls, the first planar portion has at least one pair of mounting holes, the second planar portion has at least one pair of mounting holes and the third planar portion has at least one pair of mounting holes and each of the respective pairs of mounting holes are aligned within a common vertical plane, wherein the pair of hinges that is connected to the hinge bracket for use in a full overlay system is connected to mounting holes that are vertically aligned with hinge mounting holes on a slide member of the pocket door slide system that accept mounting of a hinge to provide an inset system when not using the hinge bracket.

5. A hinge mounting assembly in accordance with claim 1, wherein the pocket door slide system is adapted to use a synchronizing system that synchronizes sliding movements of at least two door slides.

6. A hinge mounting assembly in accordance with claim 5, wherein the synchronizing system includes a follower strip that is connected to and configured to synchronize sliding movements of at least two door slides.

7. A hinge mounting assembly in accordance with claim 5, wherein the synchronizing system is adapted to use a rack and pinion system to synchronize sliding movements of at least two door slides.

8. A hinge mounting assembly in accordance with claim 5, wherein the synchronizing system includes a cable adapted synchronize sliding movements of at least two door slides.

9. A pocket door slide system comprising at least two pocket door slides, at least two hinge brackets and at least four hinges;

each pocket door slide having a slidable member and being adapted for connection to one of the at least two respective hinge brackets with each hinge bracket further being adapted for connection to at least two of the four hinges;

the pocket door slide system for use in a cabinet including at least two outer side walls, at least two inner side walls parallel to and spaced inward from the outer side walls, and top and bottom panels and having at least one door having an outer edge and the door being movable from an open position substantially within the cabinet and with the door substantially parallel to one of the outer side walls to a closed position having a full overlay position wherein the outer edge of the door is substantially in a plane defined by an outer surface of the outer side wall when the pocket door slide is to be connected to an outer surface of one of the inner side walls and the door is to be connected to the hinges; the pocket door slide system being convertible for use by connection to an inner surface of one outer side wall of a cabinet having at least two outer side walls and top and bottom panels and having at least one door having an outer edge and the door being movable from an open position substantially within the cabinet and parallel to the one outer side wall to a closed position having a full inset or partial overlay position relative to the one outer side wall and substantially perpendicular to the one outer side wall when the pocket door slide system is connected to an inner surface of the one of the outer side walls and the at least two of the four hinges are is connected to each of the pocket door slides of the door slide system without use of one of the hinge brackets and in the location the hinge bracket otherwise would be connected to the door slide system, each hinge bracket having first and second planar portions spaced apart and within a common plane and a third planar portion in a separate plane spaced apart from and parallel to said common plane, the first planar portion and third planar portion being connected by a first offset portion and the second planar portion and third planar portion being connected by a second offset portion with the first and second offset portions being spaced apart wherein a first hinge of the at least two of the four hinges is connected to the first planar portion, a second hinge of the at least two of the four hinges is connected to the second planar portion, and the third planar portion being adapted to be connected to the slidable member by at least one fastener.

10. A pocket door slide system in accordance with claim 9, wherein the common plane of the first and second planar portions is spaced apart from the third planar portion in the range of 0.59 to 1.13 inches.

11. A pocket door slide system in accordance with claim 9, wherein each of the first, second and third planar portions includes at least a pair of mounting holes and all of the mounting holes are vertically aligned in a single plane, whereby the first and second hinges mounted to the hinge bracket for use in a full overlay system are mounted to mounting holes that are vertically aligned with hinge mounting holes on a slide member of the pocket door slide system that provide an inset system.

12. A pocket door slide system in accordance with claim 9, further comprising at least a pair of holes spaced 32 mm apart on each of the planar portions.

13. A pocket door slide system in accordance with claim 12, further comprising at least two pair of holes in the third planar portion with each respective pair of holes being spaced 32 mm apart.

14. A method of providing a pocket door slide system that includes a hinge mounting assembly that can be used to connect a door to a cabinet wherein the cabinet has at least two outer side walls and top and bottom panels with the door being movable from an open position substantially within the cabinet and substantially parallel to the one outer side wall to a closed position having a full inset or partial overlay position relative to the one outer side wall and substantially perpendicular to the one outer side wall, or can be used to connect a door to a cabinet wherein the cabinet further comprises at least two inner side walls parallel to and spaced inward from the outer side walls, and wherein the at least one door has an outer edge and is movable from an open position substantially within the cabinet and with the door substantially parallel to one of the inner side walls to a closed position having a full overlay door position relative to the one outer side wall, the method comprising:

providing at least two slides and a hinge mounting assembly having at least four hinges and at least a pair of hinge brackets; and mounting the at least two slides to an inner surface of an outer side wall of a cabinet, and mounting at least two hinges to each slide and to a door; or mounting the at least two slides to an outer surface of an inner wall of a cabinet, mounting a hinge bracket to each slide, and mounting a pair of hinges to each hinge bracket and to a door;

wherein each hinge bracket comprises a first planar portion spaced apart from and within a common plane of a second planar portion, the common plane of the first and second planar portions being spaced apart from and substantially parallel to a third planar portion within a separate plane, the first planar portion being connected to the third planar portion by a first offset portion and the second planar portion being connected to the third planar portion by a second offset portion, wherein the first offset portion is spaced apart from the second offset portion, and wherein the third planar portion of the hinge bracket is adapted to be connected to a slide wherein a first hinge of the pair of hinges is connected to the first planar portion, and a second hinge of the pair of hinges is connected to the second planar portion.

* * * * *